US006077086A

United States Patent [19]

LaRoche

[11] Patent Number: 6,077,086

[45] Date of Patent: Jun. 20, 2000

[54] ELECTRIC OUTLET EXTENSION DEVICE

[76] Inventor: Wilfred LaRoche, 15 Buchanan Rd., Salem, Mass. 01970

[21] Appl. No.: 09/026,144

[22] Filed: Feb. 19, 1998

[51] Int. Cl.[7] ..... H01R 41/00

[52] U.S. Cl. ..... 439/32; 439/652; 439/173

[58] Field of Search ..... 439/32, 33, 652, 439/651, 573, 171, 173, 174

[56] References Cited

U.S. PATENT DOCUMENTS

| | | | |
|---|---|---|---|
| 3,188,596 | 6/1965 | Turner | 439/573 |
| 4,245,873 | 1/1981 | Markowitz | 439/32 |
| 5,122,082 | 6/1992 | Lee | 439/652 |
| 5,562,488 | 10/1996 | Neiser et al. | 439/652 |
| 5,895,275 | 4/1999 | Harbertson | 439/32 |

*Primary Examiner*—Gary F. Paumen

[57] ABSTRACT

A new electric outlet extention device for extending the location of the electrical sockets of an outlet. The inventive device includes an elongate member having opposite first and second ends, front and back surfaces, and opposite sides surfaces. The elongate member is telescopically extendible along its longitudinal axis extending between its first and second ends. Each of the side surfaces has a pair of electrical sockets that are located towards the first end of the elongate member. The back surface of the elongate member has an electrical plug extending therefrom and is located towards the second end of the elongate member. The plug of the back surface is electrically connected to the electrical sockets of the side surfaces.

7 Claims, 2 Drawing Sheets

ELECTRIC OUTLET EXTENSION DEVICE

BACKGROUND OF THE INVENTION

1. Field of the Invention

The present invention relates to electric outlet extension devices and more particularly pertains to a new electric outlet extention device for extending the location of the electrical sockets of an outlet.

2. Description of the Prior Art

The use of electric outlet extension devices is known in the prior art. More specifically, electric outlet extension devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art electric outlet extension devices include U.S. Pat. No. 4,146,281; U.S. Pat. No. 4,867,702; U.S. Pat. No. 5,308,253; U.S. Pat. No. 5,419,409; U.S. Pat. No. 5,399,102; and U.S. Pat. No. Des. 355,890.

While these devices fulfill their respective, particular objectives and requirements, the aforementioned patents do not disclose a new electric outlet extention device. The inventive device includes an elongate member having opposite first and second ends, front and back surfaces, and opposite sides surfaces. The elongate member is telescopically extendible along its longitudinal axis extending between its first and second ends. Each of the side surfaces has a pair of electrical sockets that are located towards the first end of the elongate member. The back surface of the elongate member has an electrical plug extending therefrom and is located towards the second end of the elongate member. The plug of the back surface is electrically connected to the electrical sockets of the side surfaces.

In these respects, the electric outlet extention device according to the present invention substantially departs from the conventional concepts and designs of the prior art, and in so doing provides an apparatus primarily developed for the purpose of extending the location of the electrical sockets of an outlet.

SUMMARY OF THE INVENTION

In view of the foregoing disadvantages inherent in the known types of electric outlet extension devices now present in the prior art, the present invention provides a new electric outlet extention device construction wherein the same can be utilized for extending the location of the electrical sockets of an outlet.

The general purpose of the present invention, which will be described subsequently in greater detail, is to provide a new electric outlet extention device apparatus and method which has many of the advantages of the electric outlet extension devices mentioned heretofore and many novel features that result in a new electric outlet extention device which is not anticipated, rendered obvious, suggested, or even implied by any of the prior art electric outlet extension devices, either alone or in any combination thereof.

To attain this, the present invention generally comprises an elongate member having opposite first and second ends, front and back surfaces, and opposite sides surfaces. The elongate member is telescopically extendible along its longitudinal axis extending between its first and second ends. Each of the side surfaces has a pair of electrical sockets that are located towards the first end of the elongate member. The back surface of the elongate member has an electrical plug extending therefrom and is located towards the second end of the elongate member. The plug of the back surface is electrically connected to the electrical sockets of the side surfaces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electric outlet extention device apparatus and method which has many of the advantages of the electric outlet extension devices mentioned heretofore and many novel features that result in a new electric outlet extention device which is not anticipated, rendered obvious, suggested, or even implied by any of the prior art electric outlet extension devices, either alone or in any combination thereof.

It is another object of the present invention to provide a new electric outlet extention device which may be easily and efficiently manufactured and marketed.

It is a further object of the present invention to provide a new electric outlet extention device which is of a durable and reliable construction.

An even further object of the present invention is to provide a new electric outlet extention device which is susceptible of a low cost of manufacture with regard to both materials and labor, and which accordingly is then susceptible of low prices of sale to the consuming public, thereby making such electric outlet extention device economically available to the buying public.

Still yet another object of the present invention is to provide a new electric outlet extention device which provides in the apparatuses and methods of the prior art some of the advantages thereof, while simultaneously overcoming some of the disadvantages normally associated therewith.

Still another object of the present invention is to provide a new electric outlet extention device for extending the location of the electrical sockets of an outlet.

Yet another object of the present invention is to provide a new electric outlet extention device which includes an elongate member having opposite first and second ends, front and back surfaces, and opposite sides surfaces. The elongate member is telescopically extendible along its longitudinal axis extending between its first and second ends. Each of the side surfaces has a pair of electrical sockets that are located towards the first end of the elongate member. The back surface of the elongate member has an electrical plug extending therefrom and is located towards the second end of the elongate member. The plug of the back surface is electrically connected to the electrical sockets of the side surfaces.

Still yet another object of the present invention is to provide a new electric outlet extention device that permits the locating of the sockets of hard to reach outlets with easy reach.

Even still another object of the present invention is to provide a new electric outlet extention device that may be used to raise the location of an outlet so that a user may easily reach the sockets without bending down.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
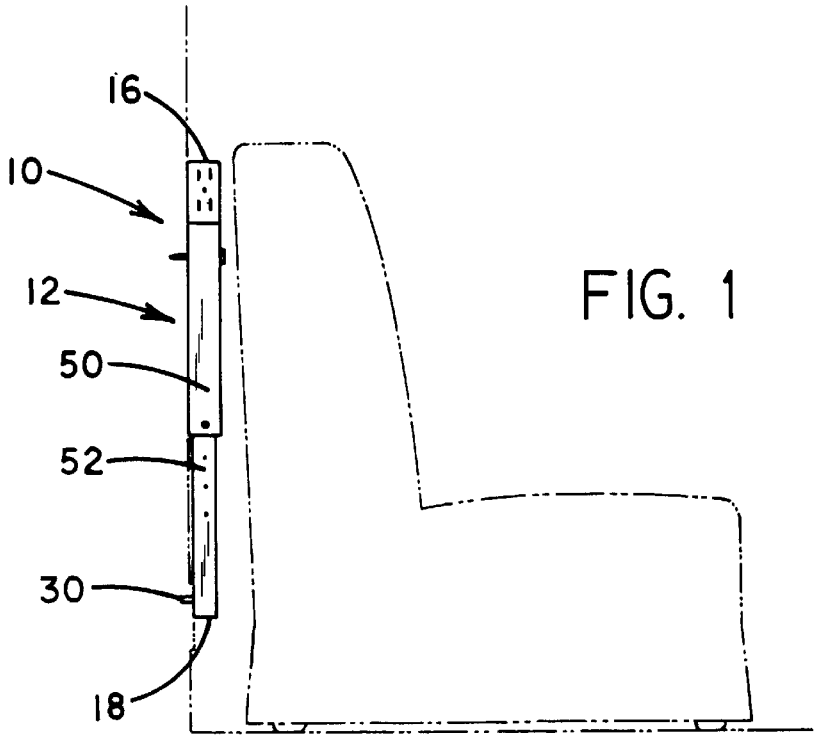
FIG. 1 is a schematic side view of a new electric outlet extention device in use according to the present invention.

With reference now to the drawings, and in particular to FIGS. 1 through 7 thereof, a new electric outlet extention device embodying the principles and concepts of the present invention and generally designated by the reference numeral 10 will be described.

As best illustrated in FIGS. 1 through 7, the electric outlet extention device 10 generally comprises an elongate member 12 having opposite first and second ends 16,18, front and back surfaces 20,22, and opposite sides surfaces 24,26. The elongate member 12 is telescopically extendible along its longitudinal axis extending between its first and second ends 16,18. Each of the side surfaces 24,26 has a pair of electrical sockets 28,29 that are located towards the first end 16 of the elongate member 12. The back surface 22 of the elongate member 12 has an electrical plug 30 extending therefrom and is located towards the second end 18 of the elongate member 12. The plug 30 of the back surface is electrically connected to the electrical sockets 28,29 of the side surfaces 24,26.

Figure 2:
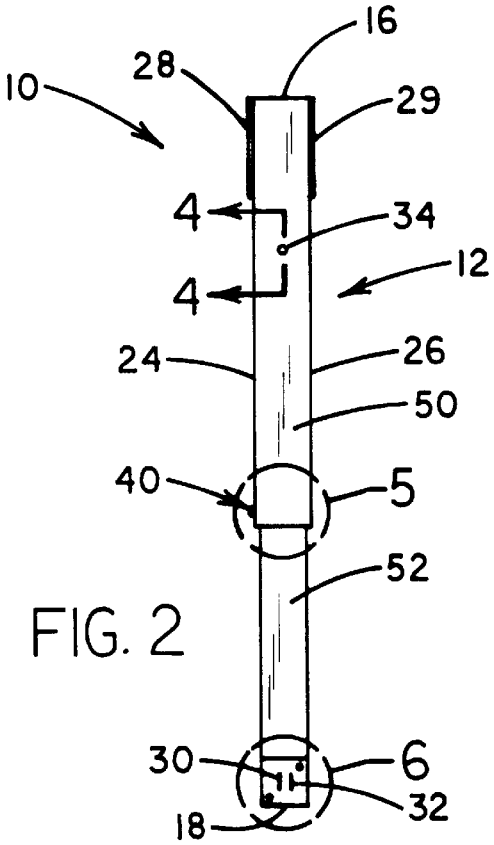
FIG. 2 is a schematic back side view of the present invention.
Figure 3:
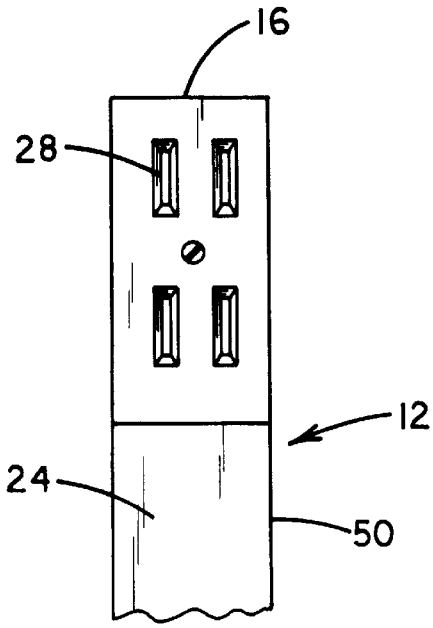
FIG. 3 is a schematic partial side view of the present invention illustrating a socket at the first end.
Figure 5:
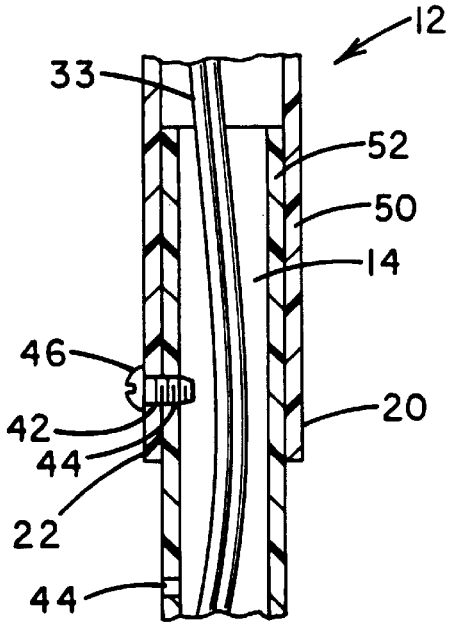
FIG. 5 is a schematic cross section view of the hold means of the present invention taken from the circle 5 of FIG. 2.
Figure 6:
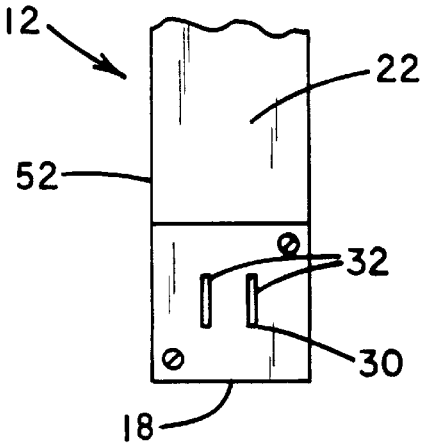
FIG. 6 is a schematic partial back side view of the plug of the present invention taken from circle 6 on FIG. 2 in the parallel orientation in relation to the longitudinal axis of the elongate member.
Figure 7:
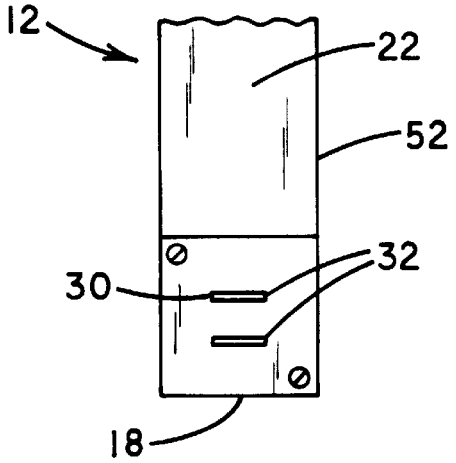
FIG. 7 is a schematic partial back side view of the plug of the present invention in the perpendicular orientation in relation to the longitudinal axis of the elongate member.

Specifically, the elongate member 12 is generally tubular and has an hollow interior 14. The longitudinal axis of the elongate member 12 is extended between the first and second ends 16, 18. Preferably, the elongate member 12 has a generally rectangular cross section taken substantially perpendicular to it longitudinal axis. As illustrated in FIGS. 2 and 3, each of the side surfaces 24,26 has a pair of electrical sockets 28,29 which are located towards the first end 16 of the elongate member 12. The electrical sockets 28,29 of the side surfaces 24,26 are designed for permitting insertion of electrical plugs 30 therein. The elongate member 12 is telescopically extendible along the longitudinal axis and preferably has first and second telescopic portions 50,52 with the first telescopic portion 50 located towards the first end 16 of the elongate member 12 and the second portion 52 located towards the second end 18 of the elongate member 12. As illustrated in FIG. 5, the second portion 52 is slidably received by the first portion 50 to permit telescopic extension of the elongate member 12.

Figure 4:
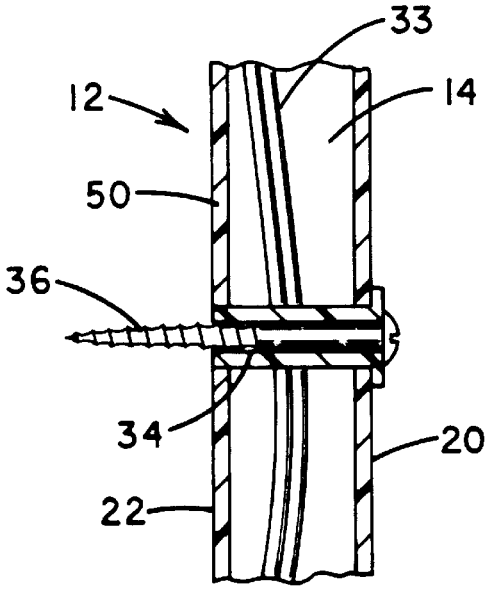
FIG. 4 is a schematic cross sectional view of the mounting bore of the present invention taken from line 4—4 of FIG. 2.

With reference to FIG. 4, the first portion 50 of the elongate member 12 preferably has a mounting bore 34 extending between the front and back surfaces 20,22 of the elongate member 12. The mounting bore 34 is designed for extending a threaded fastener 36 therethrough to help secure the elongate member 12 to a wall structure.

Also in the preferred embodiment, as illustrated in FIG. 5, a hold means 40 is included for releasably holding the second portion 52 to the first portion 50 at various extended positions. Ideally, the hold means 40 includes one of the side surfaces 24 of the second portion 52 having a plurality of spaced apart holes 44 and the first portion 50 having a hole 42 through the same side surface 24. The second portion 52 is extendible with respect to the first portion 50 such that each of the holes 44 of the second portion may be coaxially aligned with the hole 42 of the first portion 50. In this ideal embodiment, the hold means 40 preferably further includes a fastener 46 that is extendible through the hole 42 of the first portion 50 and the coaxially aligned hole 44 of the second portion 50.

The back surface 22 of the elongate member 12 has an electrical plug 30 is extended therefrom and is located towards the second end 18 of the elongate member 12. The back surface 22 of the elongate member 12 is designed for positioning adjacent a wall surface. Preferably, the electrical plug 30 has a pair of spaced apart tines 32 which are designed for insertion into an electrical socket in a wall or baseboard. The electrical plug 30 is detachable from the back surface of the elongate member 12 such that the plug 30 is attachable to the back surface 22 with the tines 32 selectively positionable in either a substantially perpendicular (FIG. 7) or substantially parallel (FIG. 6) with the longitudinal axis of the elongate member 12. This detachability of the plug 30 is designed for permitting insertion to fit variously orientated electric wall and baseboard electrical outlets. The plug can be attached to the back surface of the elongate member by any of the coupling means known such as screws, snaps, or tension. The plug 30 of the back surface 22 is electrically connected by wiring 33 within the interior 14 of the elongate member 12 to the electrical sockets 28,29 of the side surfaces 24,26.

In use, the plug 30 of the device 10 is inserted into an electrical outlet, especially a hard to reach outlet as depicted in FIG. 1. The elongate member 12 may then be extended so that the sockets 28,29 are easily accessible to a user as illustrated in FIG. 1.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electrical outlet extension device for use with a wall outlet in a wall surface, comprising:

an elongate member having an interior, opposite first and second ends, a longitudinal axis, front and back surfaces, and opposite sides surfaces, said longitudinal axis extending between said first and second ends;

each of said side surfaces having a pair of electrical sockets being located towards said first end of said elongate member;

said elongate member being telescopically extendible along said longitudinal axis; and said back surface of said elongate member having an electrical plug being extended therefrom and being located towards said second end of said elongate member, said plug of said back surface being electrically connected to said electrical sockets of said side surfaces, said electrical plug has a pair of spaced apart tines, said electrical plug being detachable from said back surface of said elongate member such that said plug is attachable to said back surface with said tines being selectively positionable either substantially perpendicular to or substantially parallel with said longitudinal axis of said elongate member; and wherein said tines of said electrical plug extend in a first direction for insertion in a wall outlet such that said first direction is orientated perpendicular to the wall surface and said pair of electrical sockets are directed in second and third directions oriented parallel to the wall surface for minimizing protrusion of plugs accepted in said sockets from the wall surface.

2. The device of claim 1, wherein said elongate member has a generally rectangular cross section.

3. The device of claim 1, wherein said elongate member has having first and second telescopic portions, said first telescopic portion being located towards said first end of said elongate member, said second portion being located towards said second end of said elongate member, said second portion being slidably received by said first portion to permit telescopic extension of said elongate member.

4. The device of claim 3, further comprising hold means for releasably holding said second portion to said first portion at a position.

5. The device of claim 4, wherein said hold means includes one of said side surfaces of said second portion having a plurality of spaced apart holes, and a corresponding side surface of said first portion having a hole, said second portion being extendible such that each of said holes of said second portion is coaxially alignable with said hole of said first portion, wherein said hold means further includes a fastener being extendible through said hole of said first portion and a coaxially aligned hole of said second portion.

6. The device of claim 1, wherein said elongate member has a mounting bore being extended between said front and back surfaces of said elongate member, said mounting bore being for extending a threaded fastener therethrough to help secure said elongate member to a wall structure.

7. An electrical outlet extension device, comprising:

an elongate member having an interior, opposite first and second ends, a longitudinal axis, front and back surfaces, and opposite sides surfaces, said longitudinal axis extending between said first and second ends, said elongate member having a generally rectangular cross section;

each of said side surfaces having a pair of electrical sockets being located towards said first end of said elongate member;

said elongate member being telescopically extendible along said longitudinal axis and having first and second telescopic portions, said first telescopic portion being located towards said first end of said elongate member, said second portion being located towards said second end of said elongate member, said second portion being slidably received by said first portion to permit telescopic extension of said elongate member;

said first portion of said elongate member having a mounting bore being extended between said front and back surfaces of said elongate member, said mounting bore being for extending a threaded fastener therethrough to help secure said elongate member to a wall structure, said mounting bore being insulated from said elongate member for preventing inadvertent grounding of said electrical plug;

hold means for releasably holding said second portion to said first portion at a position, wherein said hold means includes one of said side surfaces of said second portion having a plurality of spaced apart holes, and a corresponding side surface of said first portion having a hole, said second portion being extendible such that each of said holes of said second portion is coaxially alignable with said hole of said first portion, wherein said hold means further includes a fastener being extendible through said hole of said first portion and a coaxially aligned hole of said second portion;

said back surface of said elongate member having an electrical plug being extended therefrom and being located towards said second end of said elongate member, wherein said electrical plug has a pair of spaced apart tines, said electrical plug being detachable from said back surface of said elongate member such that said plug is attachable to said back surface with said tines being selectively positionable either substantially perpendicular to or substantially parallel with said longitudinal axis of said elongate member, said detachability of said tines being for permitting insertion to fit variously orientated electric wall and baseboard electrical outlets, said plug of said back surface being electrically connected to said electrical sockets of said side surfaces; and wherein said tines of said electrical plug extend in a first direction for insertion in a wall outlet such that said first direction is orientated perpendicular to the wall surface and said pair of electrical sockets are directed in second and third directions oriented parallel to the wall surface for minimizing protrusion of plugs accepted in said sockets from the wall surface.

* * * * *